US006148998A

United States Patent [19]

Tan

[11] Patent Number: 6,148,998

[45] Date of Patent: Nov. 21, 2000

[54] GOLF BAG BOTTOM STRUCTURE

[76] Inventor: Fu-Hsing Tan, 4th Fl., 101-1, Chi Lin Road, Yang Chou Tsun, Lu Chu, Taoyuan Hsien, Taiwan

[21] Appl. No.: 09/392,607

[22] Filed: Sep. 9, 1999

[51] Int. Cl.[7] ..... A63B 55/00

[52] U.S. Cl. ..... 206/315.3; 206/315.7

[58] Field of Search ..... 206/315.2–315.7

[56] References Cited

U.S. PATENT DOCUMENTS

| | | | |
|---|---|---|---|
| 2,105,853 | 1/1938 | Brodie | 206/315.6 |
| 2,867,257 | 1/1959 | Cart | 206/315.3 |
| 3,371,898 | 3/1968 | Murray, Jr. | 206/315.3 X |
| 3,674,072 | 7/1972 | Shuto | 206/315.6 |
| 3,747,654 | 7/1973 | Wilson | 206/315.3 |
| 3,985,229 | 10/1976 | Maki | 206/315.6 |
| 5,445,267 | 8/1995 | Biafore, Jr. | 206/315.3 X |
| 5,505,300 | 4/1996 | Joh | 206/315.6 |
| 5,573,122 | 11/1996 | Williams | 206/315.6 X |
| 5,899,328 | 5/1999 | Dulyea, Sr. | 206/315.3 |

FOREIGN PATENT DOCUMENTS

| | | | |
|---|---|---|---|
| 125826 | 10/1947 | Australia | 206/315.6 |
| 2669234 | 5/1992 | France | 206/315.3 |
| 607399 | 8/1948 | United Kingdom | 206/315.2 |

*Primary Examiner*—Sue A. Weaver
*Attorney, Agent, or Firm*—Dougherty & Troxell

[57] ABSTRACT

A golf bag bottom structure having a vertical peripheral shell, and a horizontal bottom board, the vertical peripheral shell having an upper wall, a lower wall, a plurality of connecting blocks connected between a lower part of the upper wall and an upper part of the lower wall, and a plurality of air passage holes defined between the upper wall and the lower wall and spaced from one another by the connecting blocks for circulation of air. In an alternate form of the present invention, the golf bag bottom structure has a vertical peripheral shell and a horizontal bottom board, wherein the vertical peripheral shell has a peripheral flange, a plurality of vertical through holes through the peripheral flange, and plurality of horizontal air vents perpendicularly extended from the vertical through holes for circulation of air between the outside of the golf bag bottom structure and the inside thereof.

4 Claims, 7 Drawing Sheets

GOLF BAG BOTTOM STRUCTURE

BACKGROUND OF THE INVENTION

The present invention relates to a golf bag, and more particularly to the bottom structure of a golf bag, which has air vents for circulation of outside fresh air through the inside of the golf bag, keeping the inside of the golf bag dry and, preventing storage golf clubs from a bad smell.

The bottom structure of a regular golf bag does not admit air. Because outside fresh air cannot circulate through the inside of the golf bag, storage golf clubs may be damped by moisture, causing a bad smell to be produced. If directly makes through holes horizontally through the periphery of the bottom structure of the golf bag for ventilation, outside dust and water may pass to the inside of the golf bag, resulting in another problem.

SUMMARY OF THE INVENTION

The present invention has been accomplished to provide a bottom structure for a golf bag, which eliminates the aforesaid problems. According to one embodiment of the present invention, the golf bag bottom structure comprises a vertical peripheral shell, and a horizontal bottom board, the vertical peripheral shell having an upper wall, a lower wall, a plurality of connecting blocks connected between a lower part of the upper wall and an upper part of the lower wall, and a plurality of air passage holes defined between the upper wall and the lower wall and spaced from one another by the connecting blocks for circulation of air. According to an alternate form of the present invention, the golf bag bottom structure comprises a vertical peripheral shell and a horizontal bottom board, wherein the vertical peripheral shell has a peripheral flange, a plurality of vertical through holes through the peripheral flange, and a plurality of horizontal air vents perpendicularly extended from the vertical through holes for circulation of air between the outside of the golf bag bottom structure and the inside thereof. The flange can be formed integral with the inside wall of the vertical peripheral shell, or the outside wall of the vertical peripheral shell.

DETAILED DESCRIPTION OF THE PREFERRED EMBODIMENT

Figure 1:
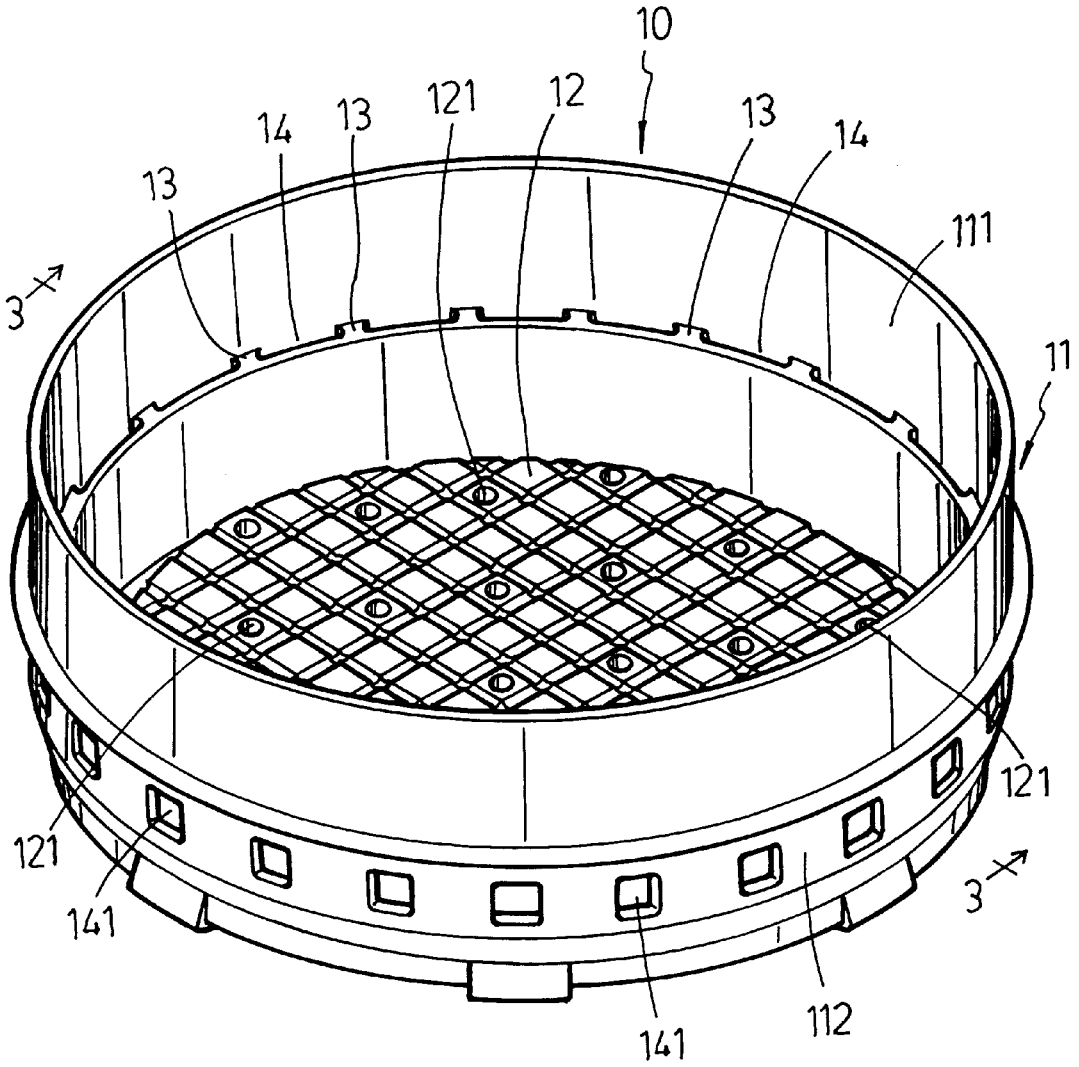
FIG. 1 is perspective view of a golf bag bottom structure according to a first embodiment of the present invention.
Figure 2:
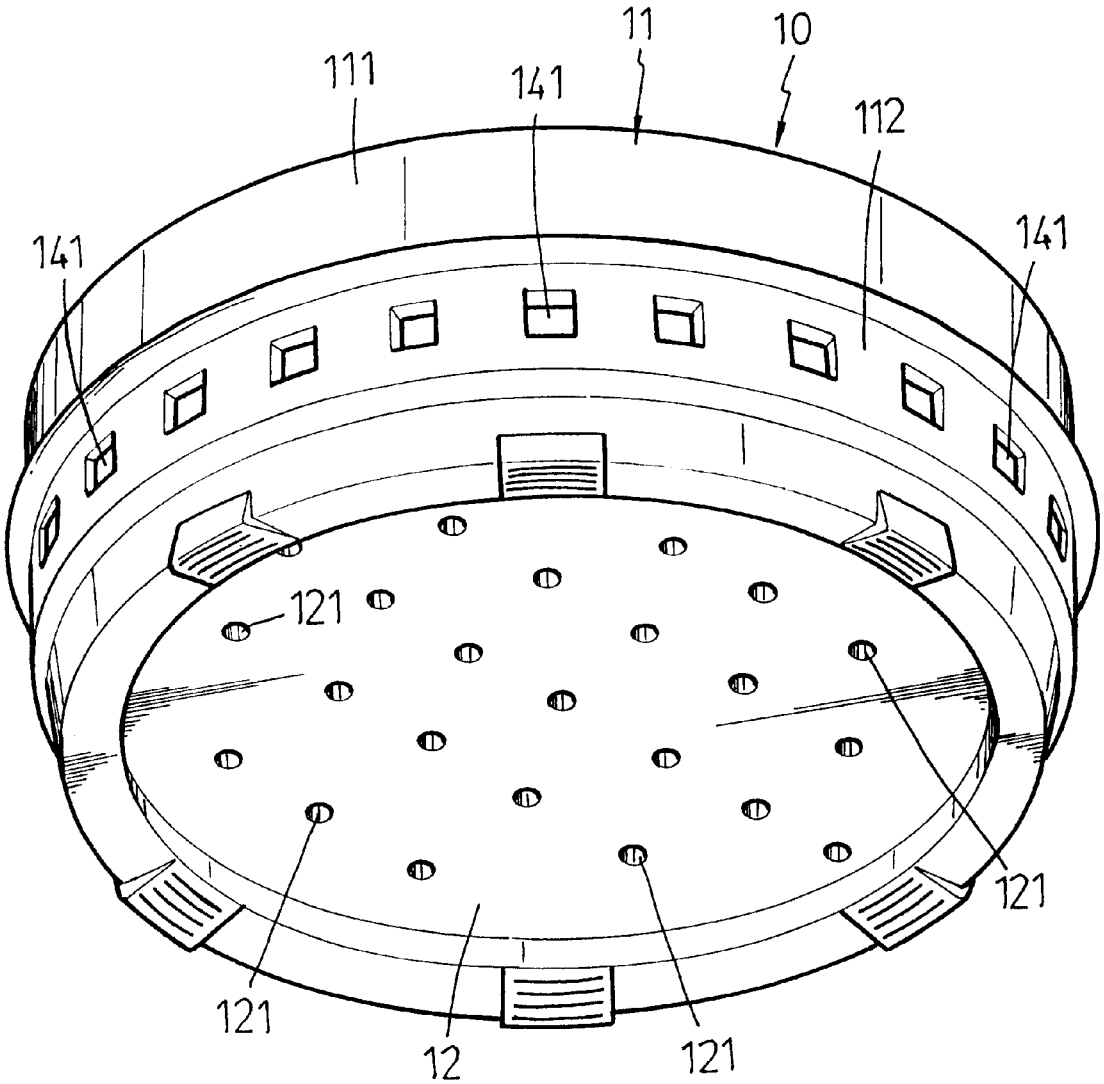
FIG. 2 is an oblique bottom elevation of the golf bag bottom structure shown in FIG. 1.
Figure 3:
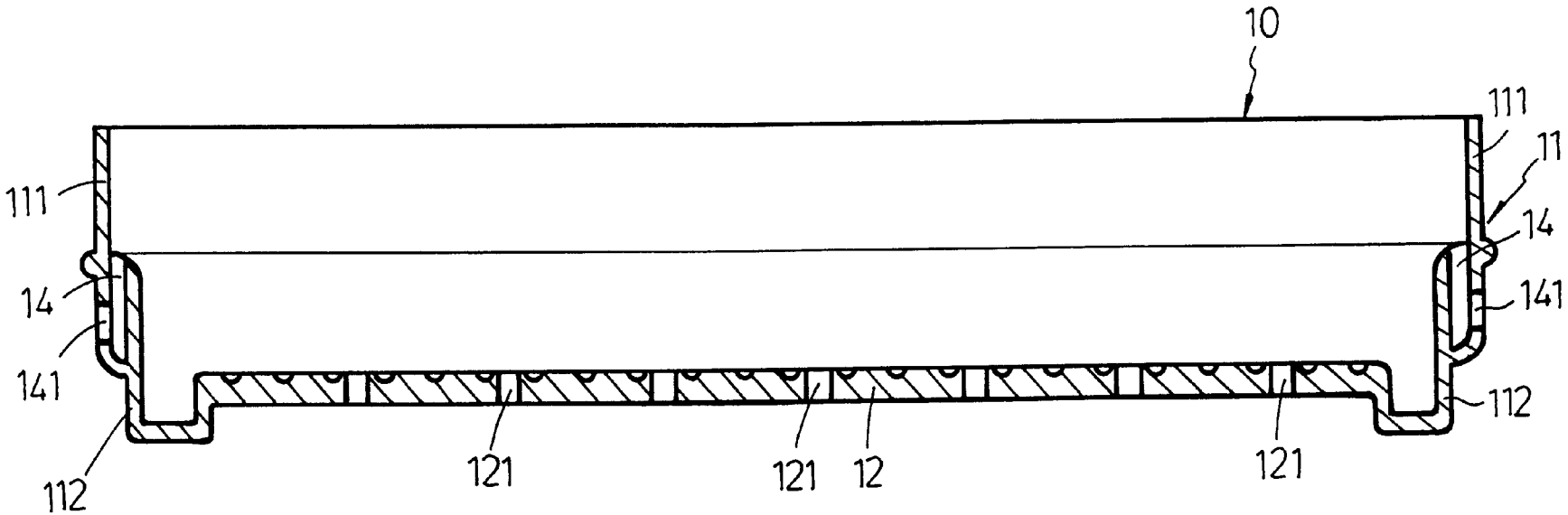
FIG. 3 is a sectional view taken along line 3—3 of FIG. 1.

Referring to FIGS. from 1 through 3, a golf bag bottom structure 10 is shown constructed according to a first embodiment of the present invention. The bottom structure 10 comprises a vertical peripheral shell 11, and a horizontal bottom board 12. The vertical peripheral shell 11 comprises an upper wall 111, a lower wall 112, and a plurality of connecting blocks 13 connected between the upper wall 111 and the lower wall 112. The bottom side of the upper wall 111 and the top side of the lower wall 112 have different diameters. For example, the diameter of the bottom side of the upper wall 111 is greater than the upper side of the lower wall 112. The connecting blocks 13 define with the upper wall 111 and the lower wall 112 a plurality of vertical air passage holes 14. The diameter of the bottom side of the upper wall 111 gradually reduces toward the bottom, having a plurality of oblique air vents 141 disposed below and in communication with the air passage holes 14 for guiding outside fresh air into the inside of the golf bag through the air passage holes 14. The horizontal bottom board 12 comprises a plurality of air vents 121 for circulation of air and drainage of water.

Figure 4:
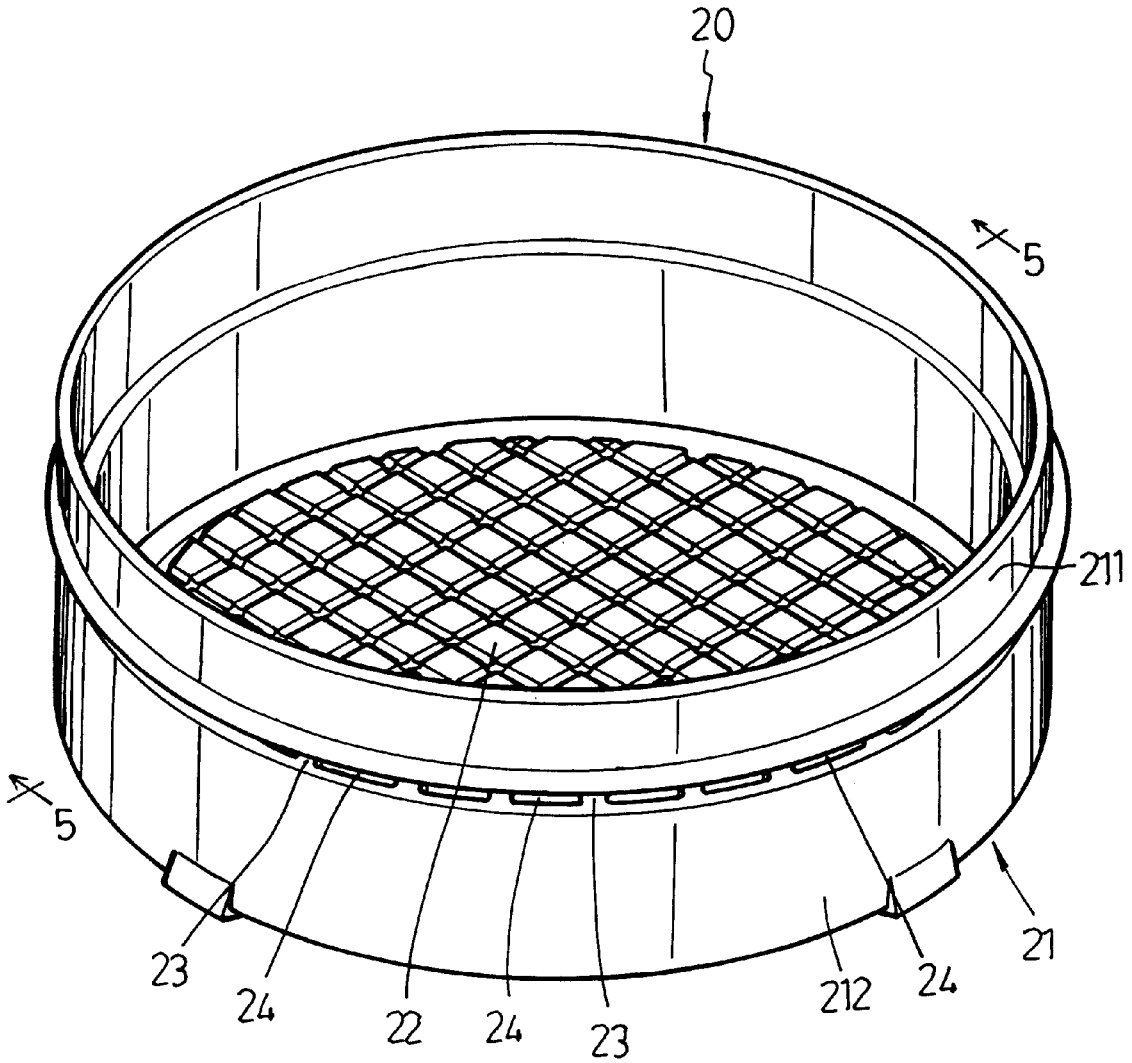
FIG. 4 is an oblique top elevation of a golf bag bottom structure according to a second embodiment of the present invention.
Figure 5:
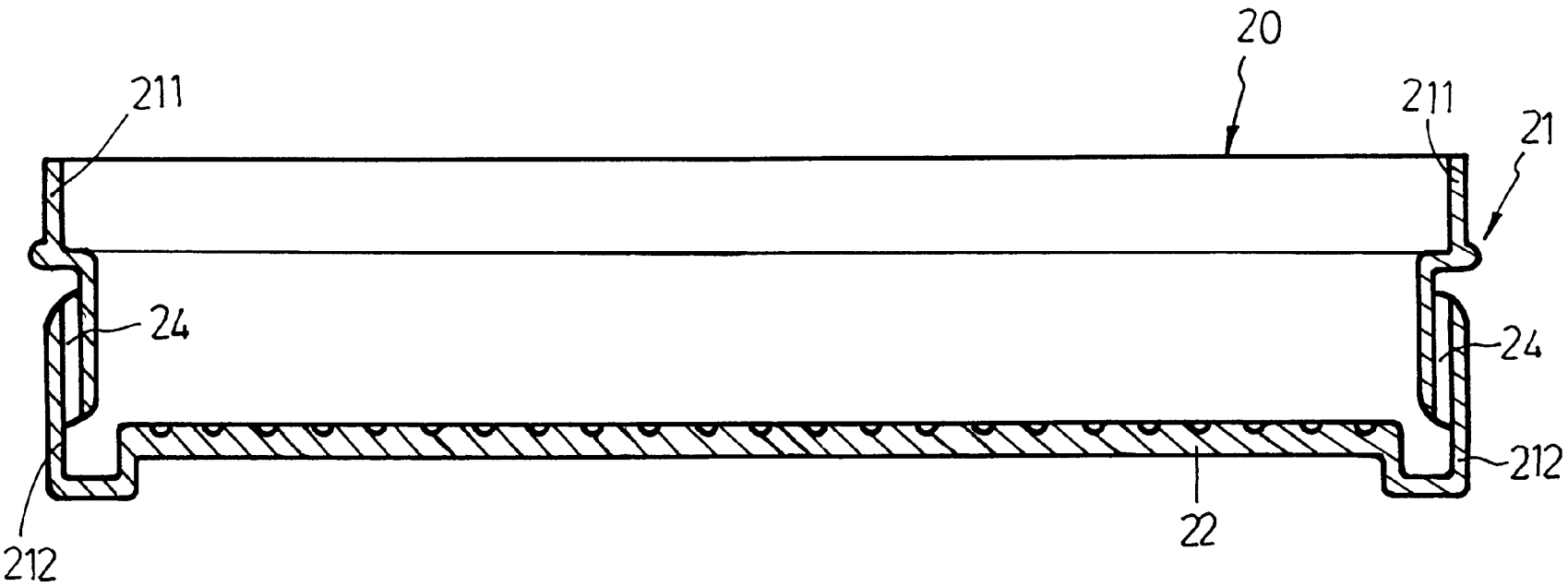
FIG. 5 is a sectional view taken along line 5—5 of FIG. 4.

Referring to FIGS. 4 and 5, a golf bag bottom structure 20 is shown constructed according to a second embodiment of the present invention. The bottom structure 20 comprises a vertical peripheral shell 21, and a bottom board 22. The vertical peripheral shell 21 comprises an upper wall 211, a lower wall 212 and a plurality of connecting blocks 23 connected between the lower part of the upper wall 211 and the upper part of the lower wall 212. The bottom side of the upper wall 211 and the top side of the lower wall 212 have different diameters. According to this embodiment, the diameter of the bottom side of the upper wall 211 is smaller than the upper side of the lower wall 212. The connecting blocks 23 define with the upper wall 211 and the lower wall 212 a plurality of vertical air passage holes 24 for guiding outside fresh air into the inside of the golf bag.

Figure 6:
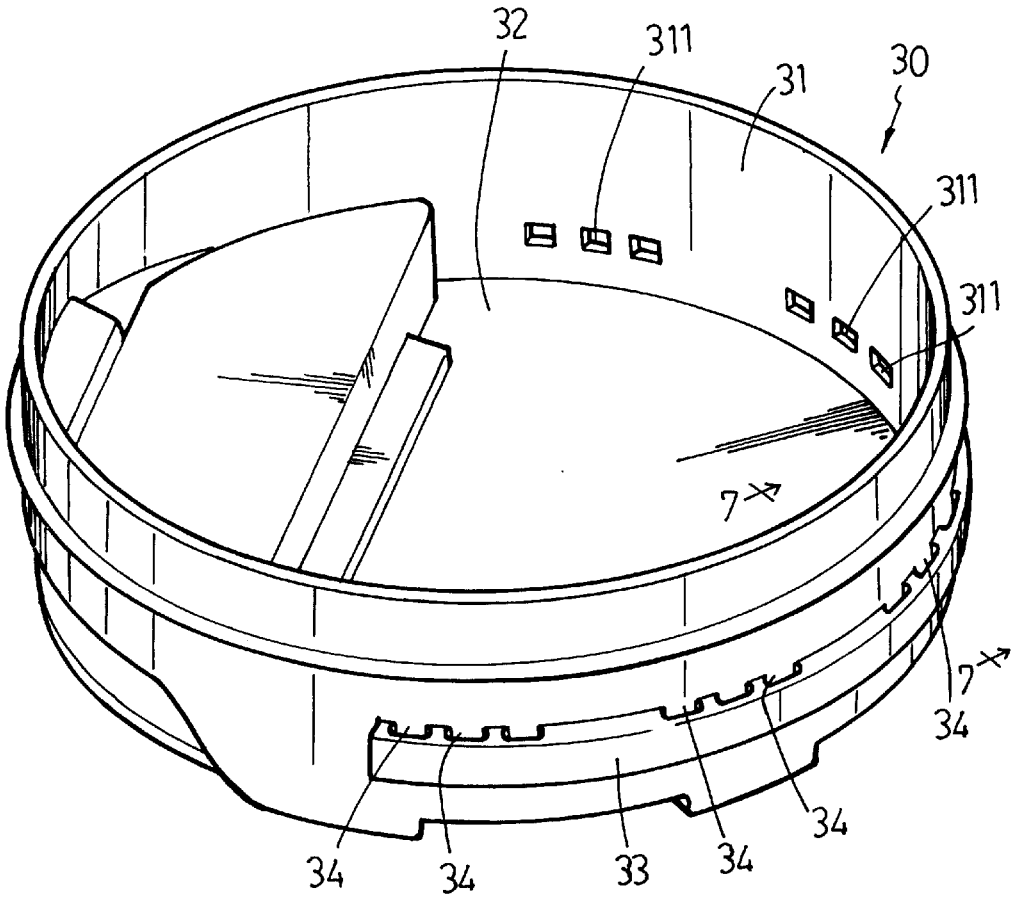
FIG. 6 is an oblique top elevation of a golf bag bottom structure according to a third embodiment of the present invention.
Figure 7:
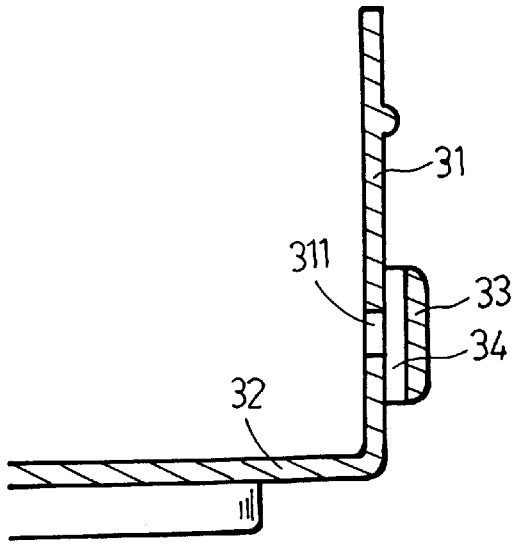
FIG. 7 is a sectional view taken along line 7—7 of FIG. 6.
Figure 8:
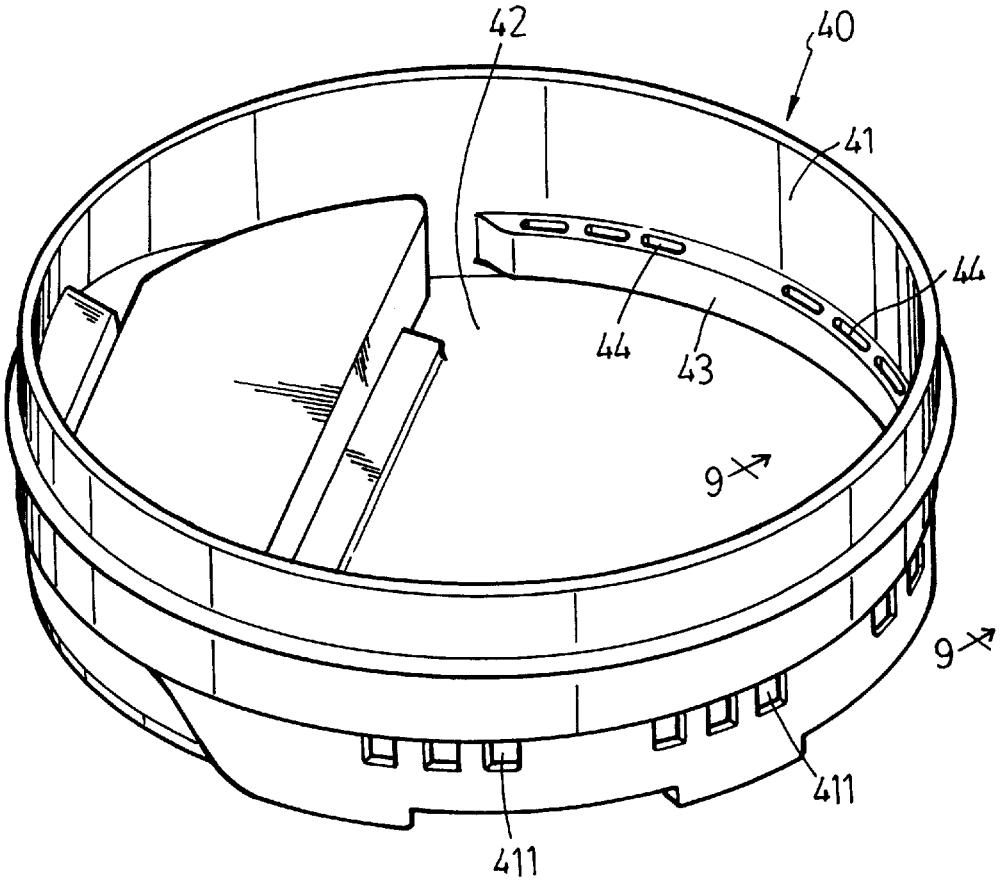
FIG. 8 is an oblique top elevation of a golf bag bottom structure according to a fourth embodiment of the present invention.
Figure 9:
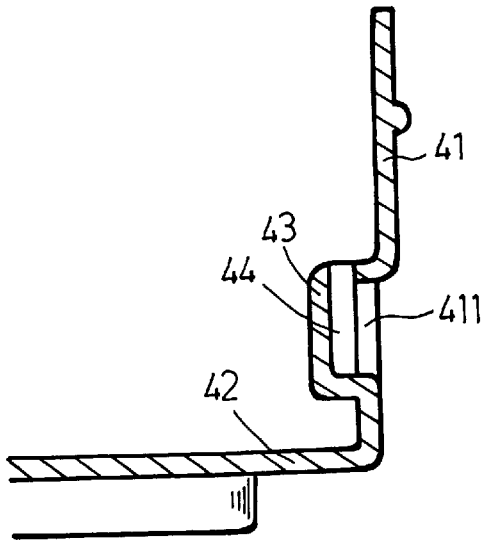
FIG. 9 is a sectional view taken along line 9—9 of FIG. 8.

Referring to FIGS. 6 and 7, a golf bag bottom structure 30 is shown constructed according to a third embodiment of the present invention. The bottom structure 30 comprises a vertical peripheral shell 31, and a bottom board 32. The vertical peripheral shell 31 comprises an outside flange 33 raised around the outside wall thereof, a plurality of vertical through holes 34 through the outside flange 33, and a plurality of horizontal air holes 311 perpendicularly extended from the vertical through holes 34 through the peripheral shell 31 to the inside of the bottom structure 30 for guiding outside fresh air into the inside of the golf bag.

Referring to FIGS. 6 and 7, a golf bag bottom structure 40 is shown constructed according to a fourth embodiment of the present invention. The bottom structure 40 comprises a stepped vertical peripheral shell 41, and a bottom board 42. The vertical peripheral shell 41 comprises an inside flange 43 raised around the inside wall thereof, a plurality of vertical through holes 44 through the inside flange 43, and a plurality of air holes 411 perpendicularly extended from the vertical through holes 44 through the peripheral shell 41 to the outside for guiding outside fresh air into the inside of the golf bag.

It is to be understood that the drawings are designed for purposes of illustration only, and are not intended for use as a definition of the limits and scope of the invention disclosed.

What the invention claimed is:

1. A golf bag bottom structure comprising a vertical peripheral shell, and a horizontal bottom board, said vertical peripheral shell comprising an upper wall, a lower wall, a plurality of connecting blocks connected between a lower part of said upper wall and an upper part of said lower wall, and a plurality of air passage holes defined between said upper wall and said lower wall and spaced from one another by said connecting blocks, wherein the lower part of said upper wall has diameter greater than the upper part of said lower wall and wherein the lower part of said upper wall comprises a plurality of air vents respectively disposed in communication with said air passage holes.

2. A golf bag bottom structure comprising a vertical peripheral shell, and a bottom board, said vertical peripheral shell comprising a peripheral flange, a plurality of vertical through holes through said peripheral flange, and a plurality of horizontal air holes perpendicularly extended from said vertical through holes through said peripheral shell for circulation of air between the outside of the golf bag bottom structure and the inside thereof.

3. The golf bag bottom structure of claim 2 wherein said flange is raised around said vertical peripheral shell on the outside.

4. The golf bag bottom structure of claim 2 wherein said flange is raised around said vertical peripheral shell on the inside.

* * * * *